US010852692B1

(12) United States Patent
Takenaka

(10) Patent No.: US 10,852,692 B1
(45) Date of Patent: Dec. 1, 2020

(54) IMAGE FORMING APPARATUS AND IMAGE FORMING METHOD

(71) Applicant: TOSHIBA TEC KABUSHIKI KAISHA, Tokyo (JP)

(72) Inventor: Sunao Takenaka, Odawara Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/571,310

(22) Filed: Sep. 16, 2019

(51) Int. Cl.
*G03G 15/08* (2006.01)
*G03G 21/20* (2006.01)

(52) U.S. Cl.
CPC ..... *G03G 21/20* (2013.01); *G03G 15/0848* (2013.01)

(58) Field of Classification Search
CPC ..... G03G 15/0848; G03G 21/20
See application file for complete search history.

(56) References Cited

U.S. PATENT DOCUMENTS 5,581,335 A * 12/1996 Borton ..... G03G 15/08 118/688
5,852,756 A * 12/1998 Teranishi ..... G03G 15/50 399/44
5,926,666 A * 7/1999 Miura ..... G03G 21/1885 399/25
7,177,559 B2 * 2/2007 Inoue ..... G03G 15/2039 399/44
7,567,764 B2 * 7/2009 Yamanaka ..... G03G 15/0812 399/284
8,554,091 B2 10/2013 Homma et al.
8,666,269 B2 * 3/2014 Tanaka ..... G03G 15/065 399/44
9,335,681 B2 * 5/2016 Ueno ..... G03G 15/2039
9,454,105 B1 * 9/2016 Onishi ..... G03G 15/0935
10,514,641 B1 * 12/2019 Kitajima ..... G03G 15/50
2002/0041767 A1 * 4/2002 Saito ..... G03G 21/1889 399/44
2004/0141761 A1 * 7/2004 Ikegawa ..... G03G 15/50 399/1
2005/0158061 A1 * 7/2005 Do ..... G03G 15/0806 399/44
2007/0098422 A1 * 5/2007 Asakura ..... G03G 15/2096 399/44
2007/0110482 A1 * 5/2007 Kazaki ..... G03G 15/0818 399/279

(Continued)

*Primary Examiner* — David J Bolduc
(74) *Attorney, Agent, or Firm* — Amin, Turocy & Watson, LLP

(57) ABSTRACT

According to one embodiment, an image forming apparatus includes a developing device, a temperature sensor, and a controller. The developing device includes a developing roller configured to develop an electrostatic latent image with a toner and is supplied with the toner from at least one toner cartridge having a storage medium configured to store temperature information regarding melting of a contained toner. The temperature sensor detects the ambient temperature of the atmosphere including the developing device. The controller is configured to drive the developing roller of the developing device based on the ambient temperature detected by the temperature sensor and the temperature information stored in the storage medium.

16 Claims, 6 Drawing Sheets

(56) References Cited

U.S. PATENT DOCUMENTS

2008/0008483 A1* 1/2008 Hamaya ..... G03G 15/166 399/44
2008/0145067 A1* 6/2008 Maeda ..... G03G 15/0887 399/8
2008/0181674 A1* 7/2008 Kaiho ..... G03G 15/0886 399/262
2008/0187854 A1* 8/2008 Yoshida ..... G03G 9/08795 430/109.4
2009/0110440 A1* 4/2009 Homma ..... G03G 15/0894 399/262
2009/0136242 A1* 5/2009 Okamoto ..... G03G 15/0863 399/13
2009/0153921 A1* 6/2009 Maeyama ..... G03G 15/5045 358/504
2011/0064430 A1* 3/2011 Mitamura ..... G03G 15/08 399/27
2011/0318022 A1* 12/2011 Ajima ..... G03G 15/0865 399/12
2012/0002987 A1* 1/2012 Odani ..... G03G 21/20 399/44
2013/0029257 A1* 1/2013 Fujita ..... G03G 9/0926 430/105
2013/0236196 A1* 9/2013 Shinohara ..... G03G 15/0863 399/12
2013/0251386 A1* 9/2013 Ozeki ..... G03G 15/0258 399/44
2014/0193168 A1* 7/2014 Kimoto ..... G03G 15/205 399/69
2015/0063838 A1* 3/2015 Yagi ..... G03G 15/0863 399/27
2015/0234321 A1* 8/2015 Suzuki ..... G03G 15/0848 399/27
2015/0338800 A1* 11/2015 Ueno ..... G03G 15/2039 399/69
2017/0364026 A1* 12/2017 Imamiya ..... G03G 21/20
2018/0024483 A1* 1/2018 Kato ..... G03G 15/08 399/94
2018/0032029 A1* 2/2018 Yamamoto ..... G03G 21/20
2018/0217535 A1* 8/2018 Koido ..... G03G 15/2039
2018/0341206 A1* 11/2018 Miyanishi ..... G03G 15/0865
2019/0227472 A1* 7/2019 Hara ..... G03G 15/0865

* cited by examiner

IMAGE FORMING APPARATUS AND IMAGE FORMING METHOD

FIELD

Embodiments described herein relate to an image forming apparatus and an image forming method.

BACKGROUND

In recent years, in image forming apparatuses, a low-temperature fixing toner is used as a developer that is fixed at a lower temperature than in the past. The low-temperature fixing toner realizes a wide non-offset region by using a crystalline polyester resin excellent in low temperature offset resistance. In an image forming apparatus, since the low-temperature fixing toner melts at a low temperature, with the increase of the ambient temperature in the apparatus by continuous image formation, various measures have been considered so that the low-temperature fixing toner does not melt in places other than the fixing device and cause a defect.

DETAILED DESCRIPTION

In general, according to one embodiment, an image forming apparatus includes a developing device, a temperature sensor, and a controller. The developing device includes a developing roller configured to develop an electrostatic latent image with a toner and is supplied with the toner from at least one toner cartridge having a storage medium configured to store temperature information regarding melting of a contained toner. The temperature sensor detects the ambient temperature of the atmosphere including the developing device. The controller is configured to drive the developing roller of the developing device based on the ambient temperature detected by the temperature sensor and the temperature information stored in the storage medium.

Hereinafter, embodiments of the present invention will be described in detail with reference to drawings.

First Embodiment

Figure 1:
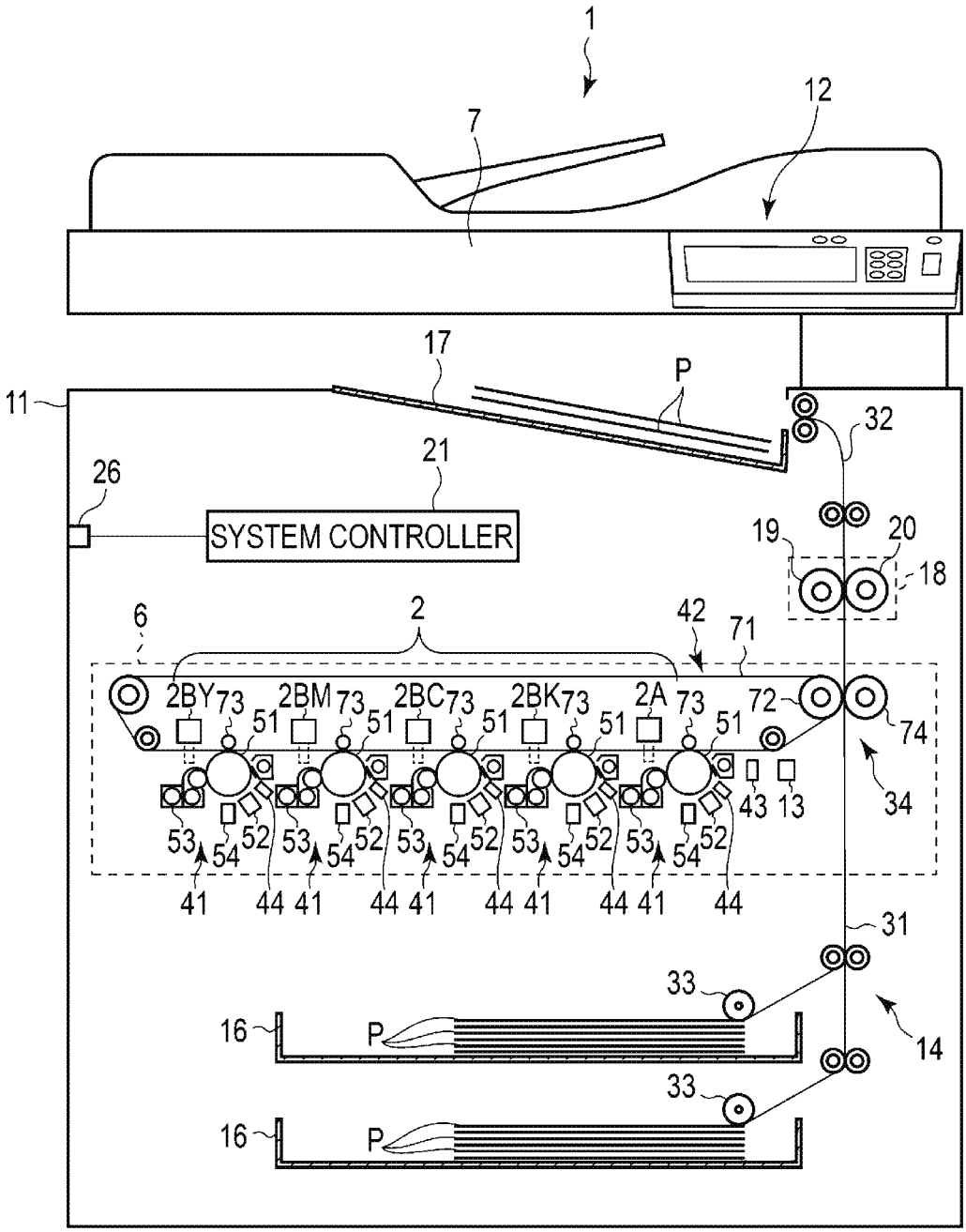
FIG. 1 is a schematic view showing an example of an internal configuration of an image forming apparatus according to a first embodiment.
Figure 2:
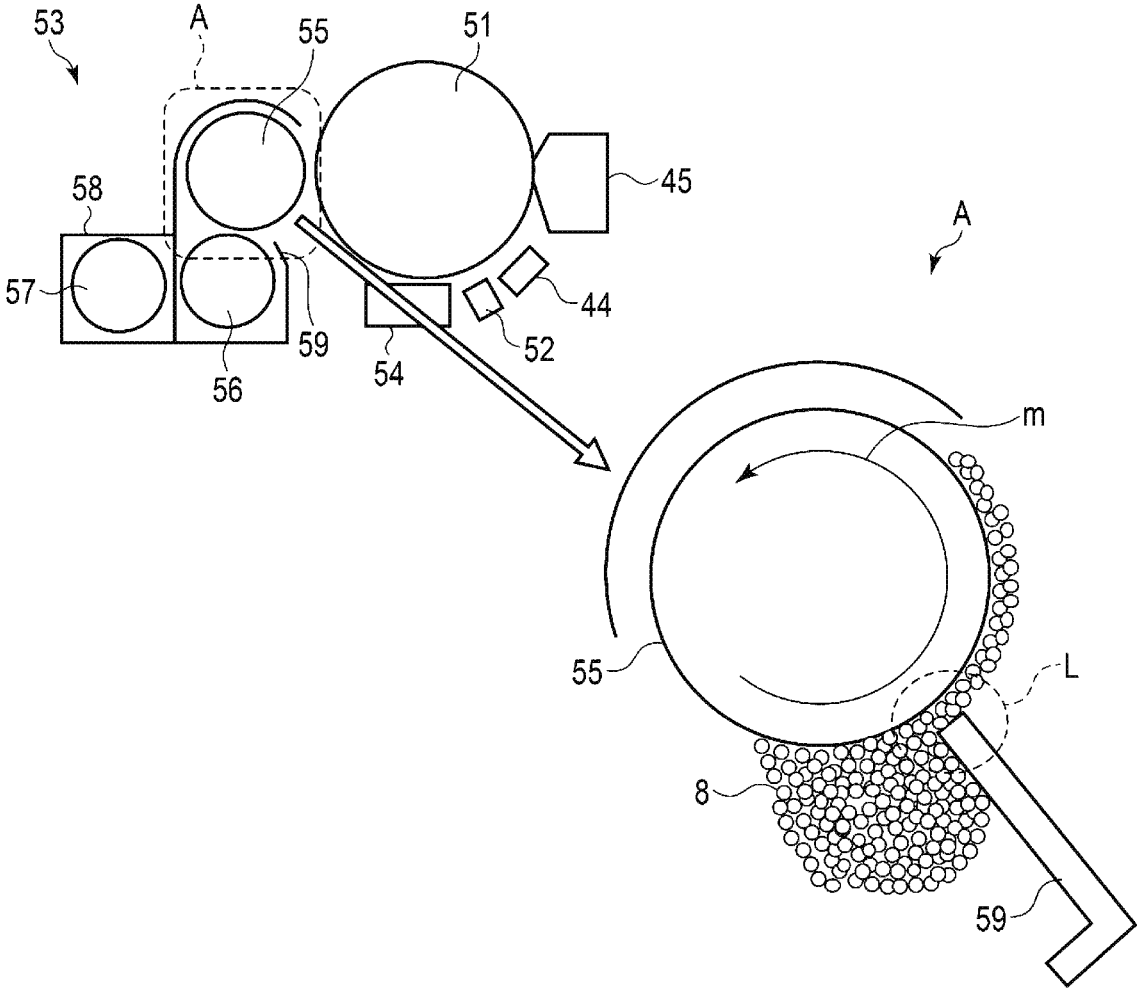
FIG. 2 is a view showing an example of a configuration of a developing device of the image forming apparatus according to the first embodiment.

FIG. 1 is a schematic view showing an example of an internal configuration of an image forming apparatus according to a first embodiment. FIG. 2 is a view showing an example of a configuration of a developing device of the image forming apparatus according to the first embodiment.

Figure 3:
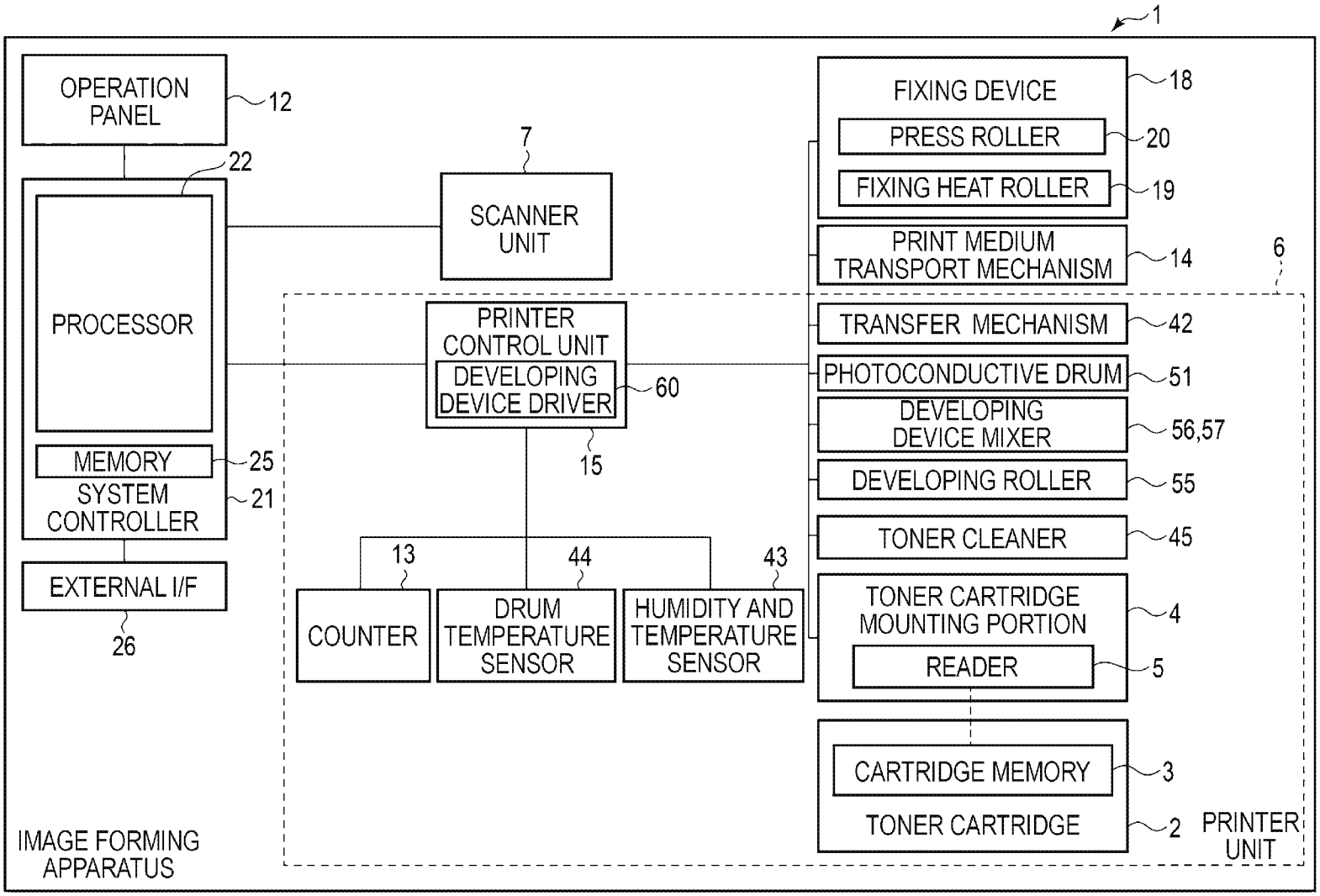
FIG. 3 is a block view showing an example of a configuration of the image forming apparatus according to the first embodiment.

FIG. 3 is a block view showing an example of a configuration of the image forming apparatus according to the first embodiment.

In the present embodiment, a multifunction peripheral (MFP) will be described as an example of the image forming apparatus. The MFP can perform various processing such as print processing of forming or printing a desired image on a print medium such as recording paper or paper, scan processing of reading an image formed on an original document to be read as image information including electronic data, and the like.

In an image forming apparatus 1 of the present embodiment, a toner (or developer) 8 is replenished from a plurality of attached toner cartridges 2, respectively, a print medium P is taken out from a supply tray 16, and an image is formed on the print medium P. The image forming apparatus 1 can use two types of low-temperature fixing toners, that is, a decolorable low-temperature fixing toner and a normal non-decolorable low-temperature fixing toner. The decolorable low-temperature fixing toner is a toner which makes the image printed on the print medium P visually unrecognizable due to heat treatment. An image or the like printed with a decolorable toner develops a blue color. In addition, ordinary toners include, for example, yellow (Y), magenta (M), cyan (C), black (K), and the like and are appropriately selected to forma color image. In the following description, the decolorable low-temperature fixing toner and the non-decolorable low-temperature fixing toner are referred to as the toner 8, but when distinguishing from other toners, the decolorable low-temperature fixing toner is called decolorable toner. In addition, the image forming apparatus can also select at least one toner cartridge 2 according to the print setting and form a monochromatic image with the toner contained in the toner cartridge 2.

The configuration of an image forming apparatus 1 of the present embodiment will be described.

As shown in FIG. 1, the image forming apparatus 1 includes an apparatus main body 11 and a scanner unit 7 disposed above the apparatus main body 11. In the apparatus main body 11, a printer unit 6, a print medium transport mechanism 14, a fixing device 18, and a plurality of supply trays 16 are disposed. The supply tray 16 is also referred to as a paper tray. Furthermore, a paper discharge tray 17 is provided on the upper surface of the apparatus main body 11. In addition, an operation panel 12 having a display screen is provided at the side of the scanner unit 7.

The plurality of the supply trays 16 are disposed in the apparatus main body 11 and configured to be pulled out. With the supply tray 16 pulled out of the apparatus main body 11, the print medium P is replenished from the outside into the supply tray 16. As the supply tray 16 is pushed back into the apparatus main body 11, the filling of the print medium P into the supply tray 16 is completed. As another method, the supply tray 16 may be a cassette container which can be detached from the apparatus main body 11. In the case of such a cassette system, the supply tray 16 is removed from the apparatus main body 11 and mounted on the apparatus main body 11 after the print medium P is replenished.

The paper discharge tray 17 is a tray that is disposed on the upper surface of the apparatus main body 11 and accommodates the print medium P discharged from the printer unit 6.

The printer unit 6 includes a plurality of process units 41, a transfer mechanism 42, a humidity and temperature sensor 43, a counter 13, and the like. The printer unit 6 includes a printer control unit 15 as shown in FIG. 3. The printer control unit 15 forms an image on the print medium P based on a print job generated by a system controller 21 described later. The printer control unit 15 includes a developing device driver 60 for rotating a developing roller 55 described later. The developing device driver 60 drives a developing roller drive motor (not shown) for driving the developing roller 55 to rotate.

Each of the plurality of process units 41 of the present embodiment includes one toner cartridge 2. The toner cartridge 2 includes a toner cartridge 2A containing a decolorable toner, a toner cartridge 2BC containing a cyan toner that is a normal color toner, a toner cartridge 2BM containing a magenta toner, a toner cartridge 2BY containing a yellow toner and a toner cartridge 2BK containing a black toner. Each toner cartridge 2 (2A, 2BY, 2BM, 2BC, and 2BK) has a cartridge memory 3 as a storage medium. The cartridge memory 3 stores temperature information indicating a reference temperature which is a temperature regarding melting of the accommodated toner 8 and individual information such as a cartridge identification number, and the like. The cartridge memory 3 is configured with, for example, an IC chip. The storage medium may be a recording medium capable of recording unique information such as a bar code instead of the memory.

Each toner cartridge 2 is exchangeably mounted in a toner cartridge mounting portion 4 provided in the apparatus main body 11. In the present embodiment, five toner cartridge mounting portions 4 are provided, and the above-described toner cartridges 2A, 2BY, 2BM, 2BC, and 2BK can be easily mounted and demounted. The toner cartridge mounting portions 4 also includes a reader 5 for reading temperature information and individual information stored in the cartridge memory 3. The temperature information and the individual information read by the reader 5 are temporarily stored in a memory 25 provided in the system controller 21.

Here, the reference temperature is determined based on, for example, a glass transition temperature (Tg) of the toner 8 which is the low-temperature fixing toner accommodated in the toner cartridge 2, and temperature information indicating the temperature is stored in the cartridge memory 3. For example, the reference temperature may be set to a temperature lower than the glass transition temperature (Tg) of the toner 8 by 2° C. The reference temperature may be determined based on the melting point temperature (Tm), which is the upper limit temperature for the toner 8. The individual information is information indicating the type and production lot number of the toner cartridge 2 and the type and color of the accommodated toner.

The glass transition temperature (Tg) can be measured, for example, by differential scanning calorimetry (DSC) using a differential calorimeter such as DSC Q2000 manufactured by TA Instruments.

As shown in FIGS. 1 and 2, each process unit 41 includes at least a photoconductive drum 51, a drum temperature sensor 44, a charger 52, a developing device 53, an exposure device 54, and a toner cleaner 45. The process unit 41 may further include a plurality of toner supply motors and the like.

The photoconductive drum 51 is a photoconductive body provided with a cylindrical drum and a photoconductive layer formed on the outer peripheral surface of the drum. The photoconductive drum 51 includes a drive mechanism such as a motor and rotates at a constant speed.

The charger 52 uniformly charges the surface of the photoconductive drum 51.

The developing device 53 is a device that causes the toner 8 to adhere to the photoconductive drum 51. As shown in FIG. 2, the developing device 53 includes the developing roller 55, developing device mixers 56 and 57, a layer restricting member 59, a developing roller driving motor (not shown), and the like in a developer container 58. In FIG. 2, the range surrounded by the upper left dashed line A is shown enlarged at the lower right.

The developer container 58 is a container for containing a two-component developer including toner and carrier. The carrier is a carrier material that is in the form of particles and is magnetic to form a toner image. In the following description of the present embodiment, the toner 8 indicates a two-component developer including toner and carrier. However, the application of the present embodiment is not limited to only the two-component developer. The present embodiment can be applied similarly even to a one-component developer and exhibits the same function and effect as the case of applying a two-component developer. In the following description, the toner 8 is equivalent to the developer.

The developing roller 55 carries the toner 8 on the surface thereof by rotating in the developer container 58. Inside the sleeve of the developing roller 55, a magnet (not shown) is incorporated. The toner 8 is attracted to the developing roller 55 by the magnet inside the developing roller, and the toner 8 is transported by the rotation of the sleeve. The layer restricting member 59 is a member disposed at a predetermined gap L from the developing roller 55 and adjusts the thickness of the toner 8 carried on the developing roller 55. The developing device mixers 56 and 57 stir the toner 8 and operate so that the toner 8 uniformly reaches the cylindrical developing roller 55.

The developing device driver 60 of the printer control unit 15 drives a developing roller drive motor (not shown) according to the instruction of the system controller 21 to rotate the developing roller 55 in a forward or backward direction. The direction of forward rotation is the direction of rotation at the time of image formation, that is, at the time of printing, and in the example shown in FIG. 2 and is a counterclockwise (CCW) direction shown by a rotation direction m. If the developing roller 55 and the photoconductive drum 51 are in contact when the developing roller 55 rotates in a backward direction, the printer control unit 15 drives a developing roller drive motor (not shown) so as to rotate the photoconductive drums 51 in synchronization. That is, the photoconductive drum 51 is rotated in the CCW direction in synchronization with the rotation of the developing roller 55 in a clockwise (CW) direction. This is to prevent the surface of the photoconductive drum 51 from being worn by the rotating developing roller 55.

The exposure device 54 includes, for example, a plurality of light emitting elements arranged in the main scanning direction which is a direction parallel to the rotation axis of the photoconductive drum 51. The light emitting element is a light emitting diode (LED) or the like. Each of these light emitting elements emits light to one point on the photoconductive drum 51. The exposure device 54 forms a latent image of one line on the photoconductive drum 51 by irradiating the photoconductive drum 51 with light by the plurality of light emitting elements arranged in the main scanning direction based on the control of the system controller 21. Furthermore, the exposure device 54 forms an electrostatic latent image on the surface of the photoconductive drum 51 charged by the charger 52 by continuously irradiating the rotating photoconductive drum 51 with light. When the developer layer formed on the surface of the developing roller 55 approaches the photoconductive drum 51, the toner 8 contained in the developer adheres to the latent image formed on the surface of the photoconductive drum 51. As a result, a toner image is formed on the surface of the photoconductive drum 51.

The drum temperature sensor 44 is disposed in the vicinity of the photoconductive drum 51 and the developer container 58 and detects the ambient temperature of the atmosphere including the photoconductive drum 51 and the developer container 58. The detected ambient temperature is sent to the system controller 21 and compared with the reference temperature read from the cartridge memory 3.

The toner cleaner 45 removes the toner 8 remaining on the photoconductive drum 51 after transferring the toner image to a primary transfer belt 71 from the surface of the photoconductive drum 51.

As shown in FIG. 1, the transfer mechanism 42 transfers the toner image formed on the surface of the photoconductive drum 51 to the print medium P by using the primary transfer belt 71 stretched in an oval shape. The transfer mechanism 42 includes the primary transfer belt 71, a secondary transfer opposite roller 72, a plurality of primary transfer rollers 73, and a secondary transfer roller 74 in the configuration shown in FIG. 1. Of course, the present invention is not limited to this configuration, and the toner image may be directly transferred from the photoconductive drum 51 to the print medium P without the intervention of the primary transfer belt 71.

The primary transfer belt 71 is an endless belt wound around the secondary transfer opposing roller 72 and a plurality of driven rollers. The primary transfer belt 71 has an inner surface (inner peripheral surface) in contact with the secondary transfer opposing roller 72 and the plurality of driven rollers, and an outer surface (outer peripheral surface) with the photoconductive drum 51 of the process unit 41.

The secondary transfer counter roller 72 is a driving roller which is disposed at the end of the oval portion of the primary transfer belt 71 and is rotated by a motor (not shown). The secondary transfer counter roller 72 transports the primary transfer belt 71 in a predetermined transport direction by rotating. A plurality of other driven rollers is configured to be freely rotatable. The plurality of driven rollers rotate in accordance with the primary transfer belt 71 moved by the secondary transfer opposing roller 72.

The plurality of the primary transfer rollers 73 are disposed at a position facing the photoconductive drum 51 with the primary transfer belt 71 interposed therebetween. The primary transfer rollers 73 are in contact with the primary transfer belt 71 so as to press the primary transfer belt 71 against the photoconductive drum 51 of the process unit 41.

The secondary transfer roller 74 is provided at a position facing the secondary transfer opposing roller 72 with the primary transfer belt 71 interposed therebetween. The secondary transfer roller 74 is in contact with the outer peripheral surface of the primary transfer belt 71, and pressure is applied to press the secondary transfer opposite roller 72. Thus, a transfer nip 34 in which the secondary transfer roller 74 and the outer peripheral surface of the primary transfer belt 71 are in close contact with each other is formed. The secondary transfer roller 74 and the secondary transfer opposing roller 72 rotate to nip and transport the print medium P together with the primary transfer belt 71. That is, the printing medium P passes through the transfer nip 34 in a state of being pressed against the outer peripheral surface of the primary transfer belt 71.

In such a configuration, the toner image formed on the surface of the photoconductive drum is transferred to the outer peripheral surface of the primary transfer belt 71. When the transfer mechanism 42 includes the plurality of the process units 41, the primary transfer belt 71 receives a toner image for each color from the photoconductive drums 51 of the plurality of the process units 41. The toner image transferred to the outer peripheral surface of the primary transfer belt 71 is transported by the primary transfer belt 71 to the transfer nip 34 in which the secondary transfer roller 74 and the outer peripheral surface of the primary transfer belt 71 are in close contact. When the print medium P is present at the transfer nip 34, the toner image transferred to the outer peripheral surface of the primary transfer belt 71 is transferred to the print medium P at the transfer nip 34.

The humidity and temperature sensor 43 is disposed between the process unit 41 disposed at the most downstream side in the transport direction of the transfer mechanism 42 and the transfer nip 34 and measures the overall ambient temperature of the transfer mechanism 42.

The fixing device 18 includes, for example, a heat roller 19 for applying heat to the print medium P and a press roller 20 for applying pressure to the print medium P, as opposed to each other.

The heat roller 19 is rotated by a motor (not shown) and heated to a high temperature by a heater (not shown) disposed in the heat roller 19. The heater can be, for example, a halogen heater or an induction heating (IH) heater.

The press roller 20 is pressurized so as to be pressed against the heat roller 19 by a tension member (not shown). As a result, a nip (fixing nip) in which the heat roller 19 and the press roller 20 are in close contact with each other is formed. The press roller 20 is rotated by a motor (not shown) to move the printing medium P entering the fixing nip while pressing the printing medium P against the heat roller 19.

Therefore, heat and pressure are applied to the print medium P passing through the fixing device 18, and the toner image is fixed on the print medium P. The print medium P that passes through the fixing device 18 is transported through a paper discharge transport path 32 and discharged to the paper discharge tray 17.

The print medium transport mechanism 14 transports the print medium P in the image forming apparatus 1. The print medium transport mechanism 14 includes a paper feed transport path 31 and the paper discharge transport path 32 divided at the position of the fixing device 18. The paper feed transport path 31 is a transport path that transports the print medium P taken in from the supply tray 16 by a pickup roller 33 to the fixing device 18 through the transfer nip 34. The paper discharge transport path 32 is a transport path for discharging the print medium P on which the image is fixed by the fixing device 18 to the paper discharge tray 17.

The paper feed transport path 31 and the paper discharge transport path 32 are each configured with a plurality of motors, a plurality of rollers, and a plurality of guides, which are not shown. The plurality of motors rotates the rollers to move the print medium P based on the control of the system controller 21. The plurality of guides controls the transport direction of the print medium P.

The counter 13 counts the number of print media on which an image is formed by a print job. The counter 13 may use, for example, an optical sensor, and is disposed between the humidity and temperature sensor 43 and the transfer nip 34. In addition, the counter 13 may be disposed on the paper discharge transport path 32 or at the tray entrance of the paper discharge tray 17.

The block configuration of the image forming apparatus 1 will be described with reference to FIG. 3. The description of the components described in FIG. 1 will be omitted or simplified.

The system controller 21 controls the entire image forming apparatus 1. The system controller 21 includes a processor 22 and the memory 25. The system controller 21 is connected to the scanner unit 7, the printer unit 6, and the operation panel 12 via a bus or the like. Further, an external interface (I/F) 26 for connecting to an external device such as a personal computer is provided.

The printer control unit 15 drives driving mechanisms and components in the apparatus main body 11 including the printer unit 6 in accordance with an instruction from the system controller 21. That is, the printer control unit 15 is connected to a motor (not shown) for driving the transfer mechanism 42, the toner cleaners 45, the photoconductive drums 51, the developing rollers 55, the developing device mixers 56 and 57, and the like in the printer unit 6 as described above, as drive targets. The printer control unit 15 is further connected to a motor (not shown) for driving the print medium transport mechanism 14, the heat roller 19 of the fixing device 18, the press roller 20, and the like as described above, as drive targets. The printer control unit 15 also supplies detection signals of various sensors disposed in the apparatus main body 11 to the system controller 21. That is, the printer control unit 15 is connected to the counter 13, the humidity and temperature sensor 43, the five drum temperature sensors 44, the reader 5 disposed in the five toner cartridge mounting portions 4, and the like as described above, as such a sensor.

The processor 22 of the system controller 21 is, for example, a CPU or a microprocessor (MPU) and performs various processing based on data such as a program stored in the memory 25. The memory 25 is a storage medium that stores programs and data used in the programs. The memory 25 includes a ROM that is a program memory, a RAM that the processor 22 uses as a work memory, a non-volatile memory (NVM) that stores various control parameters and the like in a nonvolatile manner even in a state in which the image forming apparatus 1 is not powered on.

The processor 22 can instruct the drive mechanism and components of the scanner unit 7 and the printer unit 6 to drive. For example, the processor 22 makes various determinations in accordance with detection signals of various sensors disposed in the image forming apparatus 1 supplied through the printer control unit 15 and performs various processing based on the determination results. For example, when a detection signal is received from a transport error detection sensor (not shown) disposed in the print medium transport mechanism 14, the processor 22 determines that a transport error occurs and instructs the drive mechanism and components to drive. For example, the display screen of the operation panel 12 displays the occurrence of a transport error, and a warning sound is generated by a speaker not shown.

In addition, the processor 22 stores, for example, the temperature information and the individual information read from the cartridge memory 3 of each toner cartridge 2 in the NVM of the memory 25 in a non-volatile manner. The temperature information is each reference temperature regarding the melting of the toner 8 and serves as a determination reference or threshold value as to whether or not transition prevention processing of the toner 8 is to be performed. The processor 22 compares, for example, the ambient temperature in the process unit 41 detected by the drum temperature sensor 44 with the reference temperature and determines whether or not the transition prevention processing of the toner 8 is to be performed. As described later, when the toner 8 receives heat and exceeds the glass transition temperature (Tg), the toner 8 transitions from a glass state to a rubber state. The transition prevention in the present embodiment means preventing the toner 8 from transitioning from the glass state to the rubber state. The toner transition prevention processing of the present embodiment is processing of breaking and dispersing the toner in a state of being compressed before exceeding the glass transition temperature (Tg) in order to prevent the toner that is attached to the developing roller 55 of the developing device 53 and the layer restricting member 59 and compressed from melting and adhering, as described later.

The processor 22 also generates a print job based on an image acquired from an external device via, for example, an external I/F 26 that is a communication interface. The print job includes image data indicating an image to be formed on the print medium P. The image data may be data for forming an image on one print medium P, or may be data for forming an image on a plurality of print media P. Furthermore, the print job includes information indicating whether color printing or monochrome printing is to be performed.

The operation panel 12 supplies an operation signal to the system controller 21 according to the operation of an operation member. The operation member is, for example, a touch sensor or a keyboard. The touch sensor acquires information indicating a designated position in a certain area. The touch sensor is configured as a touch panel integrally with the display screen and inputs a signal indicating the touched position on the screen displayed on the display screen to the system controller 21. The keyboard includes ten keys, a power key, a paper feed key, various function keys, and the like.

Next, the above-described decolorable low-temperature fixing toner 8 or non-decolorable low-temperature fixing toner 8 used by the image forming apparatus 1 of the present embodiment will be described. Here, the non-decolorable low-temperature fixing toner 8 (hereinafter, referred to as toner) will be described as an example.

The toner 8 is a low-temperature fixing toner which is fixed in the fixing device 18 at a temperature lower than that of the toner of the related art. Before the toner 8 is put into the fixing device 18, the resin of the toner is maintained at a temperature at which the toner starts melting, for example, a temperature equal to or lower than the glass transition temperature (Tg) in a rigid shape. The glass transition temperature (Tg) of the low-temperature fixing toner is generally 50° C. or less. There are also low-temperature fixing toners having a glass transition temperature (Tg) of 40° C. or less. When the toner 8 passes through the fixing nip between the heat roller 19 of the fixing device 18 and the press roller 20, if the toner 8 receives heat due to the heating of the heat roller 19 and the temperature exceeds the glass transition temperature (Tg), the toner 8 transitions so as to soften from the glass state to the rubber state. When the toner 8 transitions to the rubber state, the toner 8 is easily deformed when pressure is applied and easily adheres to an object in contact. In the fixing device, when the toner 8 continues to be heated even after transitioning to the rubber state, and thus further transitions to a fluidized state, and is flattened by the pressure of the press roller 20, if the inside of the print medium P, for example, the print medium P is a recording sheet, the toner 8 enters between the fibers. After the print medium P leaves the fixing device 18, the toner 8 solidifies with a temperature drop, returns to the glass state, and is fixed.

If there is a portion other than the fixing device 18 that gives heat higher than the glass transition temperature at which the toner 8 starts melting, the toner 8 changes to a rubber state at that portion and adheres to the portion. When the toner 8 adheres to the transport path of the print medium P, the print medium P may be contaminated, or a transport error in the print medium transport mechanism 14 of the image forming apparatus 1, that is, a defect such as jam may occur.

Another example of a portion that causes a defect is, for example, the developing device 53 that is in contact with the toner 8, is disposed in the vicinity of the photoconductive drum 51, and is likely to cause a temperature rise, as shown in FIG. 2.

In the developing device 53, the gap L between the developing roller 55 in contact with the photoconductive drum 51 and the blade tip of the layer restricting member 59 is provided. The layer restricting member 59 restricts the toner 8 attached to the developing roller 55 to flow with a uniform thickness so that the toner 8 at the tip end portion of the layer restricting member 59 is likely to be strongly stressed. Therefore, the toner 8 in contact with the tip end portion of the layer restricting member 59 and the developing roller 55 is pressed and solidified. When print jobs are continuously performed, if the toner 8 is compressed and solidified for a long time and the ambient temperature rises, the toner 8 melts and adheres to the layer restricting member 59 or the like. For example, when the toner 8 clogs the gap L, the toner 8 may not be properly attached to the photoconductive drum 51 or may be adhered to the developing roller 55 and the tip end portion of the layer restricting member 59 to cause an operation failure of the developing roller 55.

Therefore, it is necessary to not only break down the toner in a compressed state, but also to control the temperature of the toner 8 including the developing roller 55 and the layer restricting member 59. In the present embodiment, when the ambient temperature of the atmosphere including the developing roller 55 and the photoconductive drum 51 detected by the drum temperature sensor 44 reaches the reference temperature read from the cartridge memory 3 of the toner cartridge 2, transition prevention processing is performed so that the state of the toner does not transition.

Toner Transition Prevention Processing

In the present embodiment, the transition prevention processing is processing of causing the developing roller 55 to rotate in a backward direction, which is a direction opposite to the rotation direction m that is the normal rotation direction in the print job. The backward rotation of the developing roller 55 causes the toner 8 in a state of being compressed at the tip end portion of the layer restricting member 59 and the place of the developing roller 55 to be broken and separated in the developer container 58.

The backward rotation of the developing roller 55 may be less than one rotation. Such backward rotation may be ¼ rotation as long as the toner 8 compressed at the tip end portion of the layer restricting member 59 can be broken and separated. The amount of backward rotation may be set appropriately according to the characteristics of the toner 8, that is, the size of the toner particles, the viscoelasticity, and the like.

The transition prevention processing by the backward rotation of the developing roller 55 can be performed for each process unit 41. However, it is preferable to perform the transition prevention processing efficiently. In the present embodiment, based on the frequency of use, the toner is divided into three groups: a toner of black (K) in a first group, color toners of yellow (Y), magenta (M) and cyan (C) in a second group, and a decolorable toner in a third group. This is because in monochrome printing, a black toner or a decolorable toner is used independently, but in color printing, color toners of yellow, magenta, and cyan (C) are used simultaneously.

Figure 4:
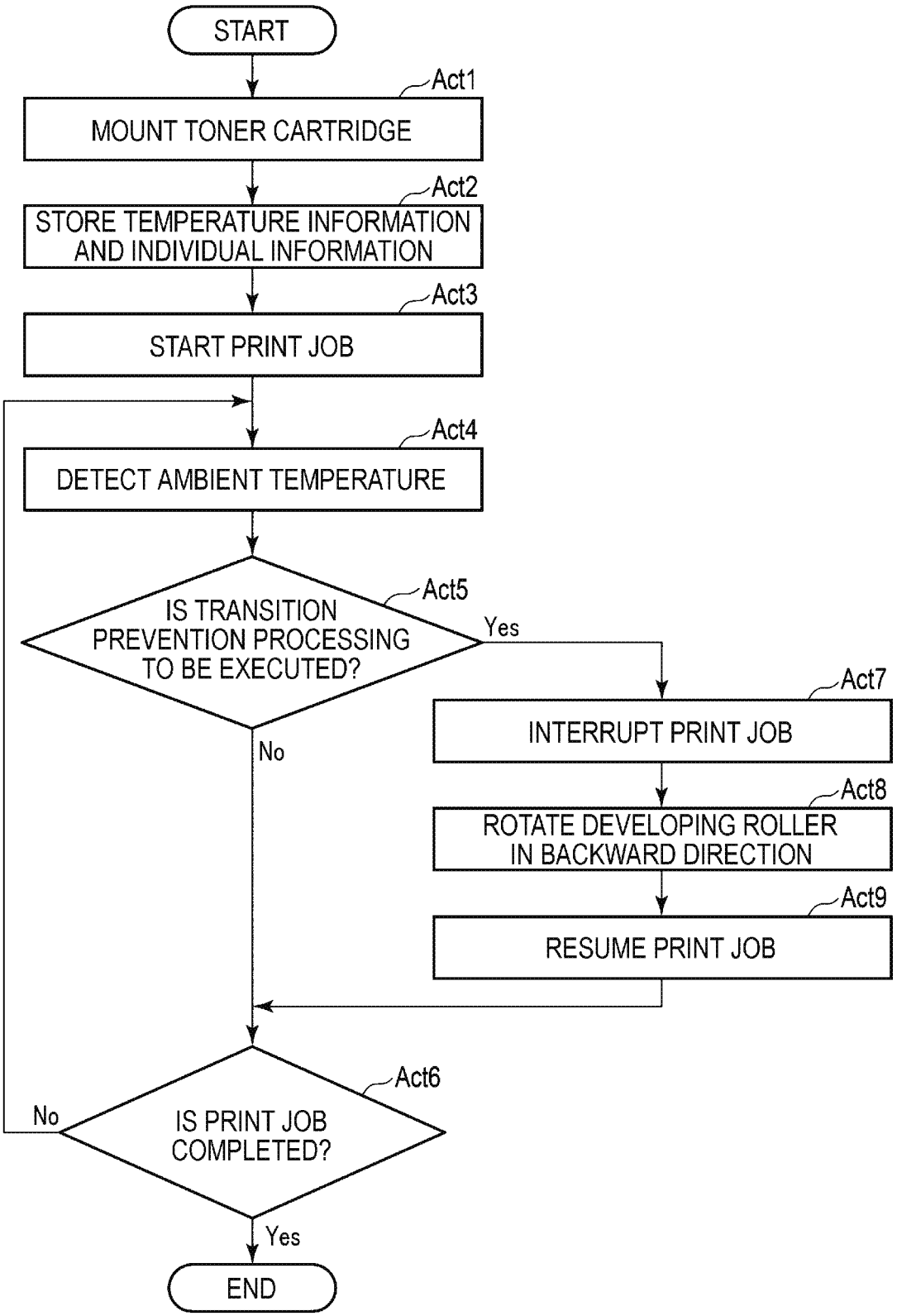
FIG. 4 is a flowchart showing an example of toner transition prevention processing of the first embodiment.

Next, an example of the toner transition prevention processing will be described with reference to the flowchart shown in FIG. 4. The processor 22 of the system controller 21 performs the control process shown in FIG. 4 in accordance with the control program stored in the memory 25. Here, it is assumed that the reference temperature regarding melting of the toner 8 stored in the cartridge memory 3 of each toner cartridge 2 is set to a temperature lower than the glass transition temperature (Tg) of the toner 8 accommodated in the toner cartridge 2 by 2° C. That is, the reference temperature may differ depending on the accommodated toner 8.

When the toner cartridge 2 is mounted on the toner cartridge mounting portion 4 (Act 1), the reader 5 reads the temperature information and the individual information from the cartridge memory 3 of the toner cartridge 2, and the processor 22 stores the temperature information and the individual information received via the printer control unit 15 in the NVM of the memory 25 (Act 2). As a result, the memory 25 stores the reference temperature for each toner cartridge 2.

When image information to be printed is supplied from an external device via the external I/F 26, or when image information to be copied is supplied from the scanner unit 7, the processor 22 generates a print job based on the image information and starts the print job (Act 3).

Here, the ambient temperature including the photoconductive drum 51 and the developer container 58 is detected by all the drum temperature sensors 44, and the processor 22 takes in the ambient temperature via the printer control unit 15 (Act 4). The processor 22 compares the taken ambient temperature with the reference temperature of each toner 8 stored in the NVM of the memory 25 to determine whether or not the transition prevention processing is to be performed (Act 5). Here, if the temperature detected by the drum temperature sensor 44 corresponding to any of the toners 8 reaches the reference temperature of the corresponding toner, the processor 22 determines that the transition prevention processing is to be performed.

If it is determined that the transition prevention processing is not to be performed (No in Act 5), the processor 22 determines whether or not all print jobs end (Act 6). If it is determined that a print job still remains (No in Act 6), the processor 22 continues the ambient temperature detection in Act 4.

If it is determined that the transition prevention processing is to be performed (Yes in Act 5), the processor 22 interrupts the print job (Act 7). After interrupting the print job, the processor 22 instructs the printer control unit 15 to rotate the developing rollers 55 of all the process units 41 in a backward direction (Act 8). That is, the printer control unit 15 rotates the developing roller drive motors (not shown) of all the process units 41 by the developing device driver 60 in accordance with the instruction of the processor 22 to rotate the developing roller 55 in a backward direction. By the backward rotation of the developing roller 55, the toner of each developing device 53 is broken and separated. After that, the processor 22 resumes the print job (Act 9). Then, the processor 22 determines the end of the print job in Act 6.

Thus, if it is determined in Act 6 that all print jobs end, the processor 22 ends the processing of this flowchart.

In this example, an example is described in which all the developing rollers 55 are rotated in a backward direction if at least one detected ambient temperature reaches the reference temperature, but the present embodiment is not limited thereto. For example, the transition prevention processing may be performed in units of the first to third groups described above. Specifically, transition prevention processing by backward rotation may be performed for the developing roller 55 of the group including the drum temperature sensor 44 for which it is determined that the ambient temperature of the first to third groups reaches the corresponding reference temperature. That is, for the black toner of the first group and the decolorable toner of the third group, if the temperature detected by the corresponding drum temperature sensor 44 reaches the reference temperature of the corresponding toner, the transition prevention processing is executed for only the corresponding toner. For the yellow, magenta, and cyan toners of the second group, if the temperature detected by any of the drum temperature sensors 44 reaches the reference temperature of the corresponding toner, transition prevention processing is executed for all the toners of the second group, not only the corresponding toner.

In addition, whether or not the transition prevention processing is performed is determined based on whether or not the temperature detected by the drum temperature sensor 44 reaches the reference temperature of the toner 8, but whether or not the transition prevention processing is performed may be determined based on whether or not the detected temperature exceeds the reference temperature.

As described above, the image forming apparatus 1 according to the first embodiment can break and separate the toner 8 compressed so as to be in contact with the developing roller 55 in the developing device 53 and the layer restricting member 59 of the developer container 58 before the ambient temperature in the vicinity of the developing device 53 reaches a reference temperature based on the glass transition temperature. Therefore, since the toner 8 is broken and separated before the toner 8 is compressed and melted, it is possible to prevent the defect caused by the toner 8 adhering to the developing roller 55 and the layer restricting member 59 in advance. Furthermore, the image forming apparatus 1 configured in this way can interrupt the print job and prevent the decrease in the printing capability thereof more than when the image forming apparatus 1 is configured to stand by for the temperature drop of the ambient temperature.

Second Embodiment

In the first embodiment described above, it is determined whether or not to perform transition prevention processing of preventing the toner 8 from melting by using the reference temperature regarding melting of the toner read from the cartridge memory 3 of the toner cartridge 2 as one determination reference temperature or threshold value to compare the ambient temperature in the vicinity of the developing device 53 with this determination reference temperature. In the present embodiment, a plurality of determination reference temperature ranges based on the read reference temperature are used, and the execution timing of the transition prevention processing of the toner 8 is determined by comparing the ambient temperature in the vicinity of the developing device 53 with the plurality of determination reference temperature ranges.

Therefore, the memory 25 of the system controller 21 stores, as table information, for example, the relationship between a plurality of temperature ranges based on a reference range and the timing of the transition prevention processing in each temperature range. This table information can be stored in a nonvolatile manner in the NVM of the memory 25 at the time of manufacture of the image forming apparatus 1, for example. In addition, the table information stored in the memory 25 can be updated by the maintenance operation of a service person at the time of inspection/repair by the service person who maintains the image forming apparatus 1 or the like. Furthermore, this table information may be updated from an external device via the external I/F 26.

Example of Temperature Range

First temperature range: less than [reference temperature −10° C.]

Second temperature range: [reference temperature −10° C.] or higher and less than [reference temperature −5° C.]

Third temperature range: [reference temperature −5° C.] or higher and less than [reference temperature]

Fourth temperature range: [reference temperature] or higher to less than [reference temperature +2° C.]

Fifth temperature range: [reference temperature +2° C.] or higher

However, this is the case where the reference temperature is lower than the glass transition temperature (Tg) by 2° C. That is, the fifth temperature range can be reworded as being equal to or higher than a glass transition temperature.

Specific Example of Temperature Range

For example, if the glass transition temperature of the toner 8 is 47° C., the reference temperature is 45° C., which is lower than the glass transition temperature by 2° C., and 45° C. is stored in the cartridge memory 3 as temperature information. Thus, in this example, the temperature range is as follows:

First temperature range: less than 35° C.

Second temperature range: 35° C. or higher and less than 40° C.

Third temperature range: 40° C. or higher and less than 45° C.

Fourth temperature range: 45° C. or higher to less than 47° C.

Fifth temperature range: 47° C. or higher.

Example of Table Information

Temperature range: Transition prevention processing timing

First temperature range: one time of transition prevention processing each time 500 sheets are printed Second temperature range: one time of transition prevention processing each time 100 sheets are printed Third temperature range: one time of transition prevention processing each time 50 sheets are printed Fourth temperature range: one time of transition prevention processing each time 10 sheets are printed Fifth temperature range: temperature lowering processing is performed, and one time of transition prevention processing is performed when printing processing is resumed.

Here, the temperature lowering processing is processing of temporarily stopping an printing operation to increase the air flow of a cooling fan (not shown) provided in the apparatus main body 11 more than usual and cool the surroundings including the developing roller 55 and the photoconductive drum 51 to lower the ambient temperature.

As described above, the timing at which the transition prevention processing according to the temperature range is performed is set in advance. Therefore, the higher the ambient temperature detected by the drum temperature sensor 44, the higher the frequency of performing the transition prevention processing with respect to the number of processed print media P.

In the present embodiment, the toner is divided into three groups: a toner of black (K) in a first group, color toners of yellow (Y), magenta (M) and cyan (C) in a second group, and a decolorable toner in a third group. For example, the process unit 41 using the black toner of the first group and the process unit 41 using the color toners of the second group are taken as an example. In this example, if the detected ambient temperature of the first group falls within the third temperature range and the detected ambient temperature of the second group falls within the second temperature range, for the first group, one time of transition prevention processing is performed each time 50 sheets are printed, and for the second group, one time of transition prevention processing is performed each time 100 sheets are printed.

Figure 5:
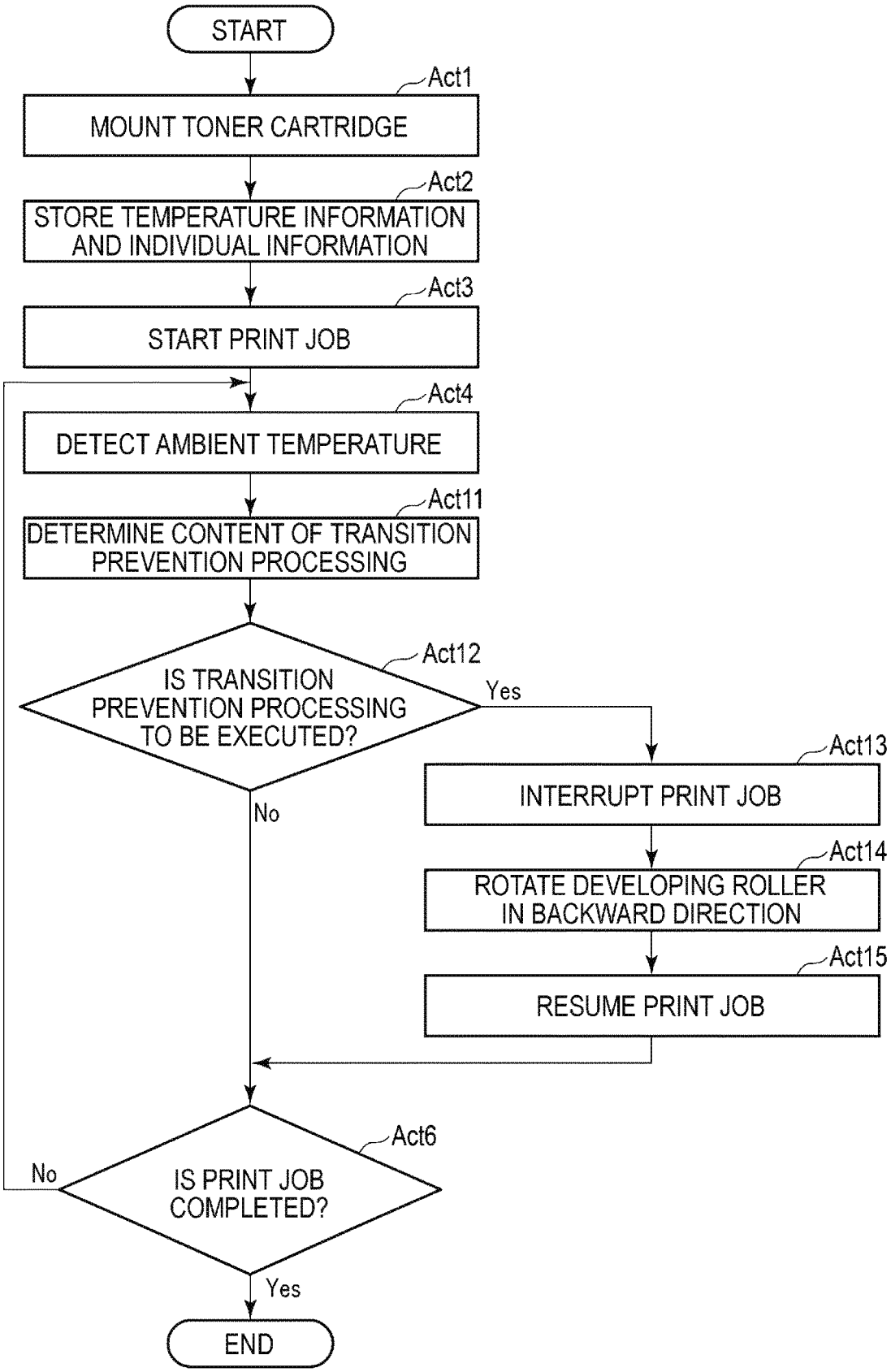
FIG. 5 is a flowchart showing a first example of toner transition prevention processing of a second embodiment.

First Example of Toner Transition Prevention Processing According to Second Embodiment Next, a first example of the toner transition prevention processing will be described with reference to the flowchart shown in FIG. 5. Here, the processing equivalent to that of the first embodiment described above is given the same reference symbol to simplify the description.

The processing of Act 1 to Act 4 is as described in the first embodiment.

The processor 22 of the system controller 21 determines the temperature range based on the reference temperature of each toner stored in the NVM of the memory 25 and the taken ambient temperature and refers to the table information stored in the NVM of the memory 25 to determine the content of performing the transition prevention processing corresponding to the temperature range for each toner 8 (Act11). For example, if the detected ambient temperature is 38° C. and the temperature range is as in the example of the temperature range described above, the temperature range is determined to be the second temperature range, and it is determined that one time of transition prevention processing is to be performed each time 100 sheets are printed.

The processor 22 determines whether or not there is the toner 8 for which the timing of performing the transition prevention processing or the temperature lowering processing comes, based on the determined content of performing the transition prevention processing (Act 12). That is, the processor 22 can determine the number of printed sheets based on the count value of the counter 13 supplied via the printer control unit 15 to determine, for example, whether 100 sheets are printed.

When it is determined that there is no toner 8 for which the timing of performing the transition prevention processing or the temperature lowering processing has come (No in Act 12), the processor 22 proceeds to Act 6 and determines whether all print jobs are completed, as in the first embodiment.

When it is determined that there is the toner 8 for which the timing of performing the transition prevention processing or the temperature lowering processing comes (Yes in Act 12), the processor 22 interrupts the print job by the process unit 41 of the corresponding group (Act 13). Then, the processor 22 breaks and separates the toner 8 in contact with the developing roller 55 by instructing the printer control unit 15 to rotate the developing roller 55 of the process unit 41 of the corresponding group (Act 14) in a backward direction. After that, the processor 22 resumes the print job of the process unit 41 of the corresponding group (Act 15). Then, the processor 22 determines the end of the print job in Act 6.

As described above, also in the image forming apparatus of the first example, as in the first embodiment, before the ambient temperature in the vicinity of the developing device 53 reaches a determination reference temperature (here, glass transition temperature −2° C.), the toner 8 compressed so as to be in contact with the developing roller 55 in the developing device 53 and the layer restricting member 59 of the developer container 58 can be broken and separated. In addition, in the present embodiment, the transition prevention processing of the toner 8 suitable for each temperature range is performed by dividing the temperature into a plurality of temperature ranges having temperature differences. That is, when the ambient temperature is low, the number of times of executing the transition prevention processing of the toner 8 is set to be lower with respect to the number of sheets of image forming processing on the print medium P, and as the ambient temperature rises, the number of times of executing the transition prevention processing of the toner 8 is set to be higher with respect to the number of sheets of the image forming processing on the print medium P. As a result, the transition prevention processing can be efficiently performed without reducing the operation time.

In the first example, the transition prevention processing is performed after an image is formed on the set number of the print media P after a print job is started. In addition to this, transition prevention processing may be performed to break and separate the toner to be compressed each time all print jobs are completed.

Second Example of Toner Transition Prevention Processing

Figure 6:
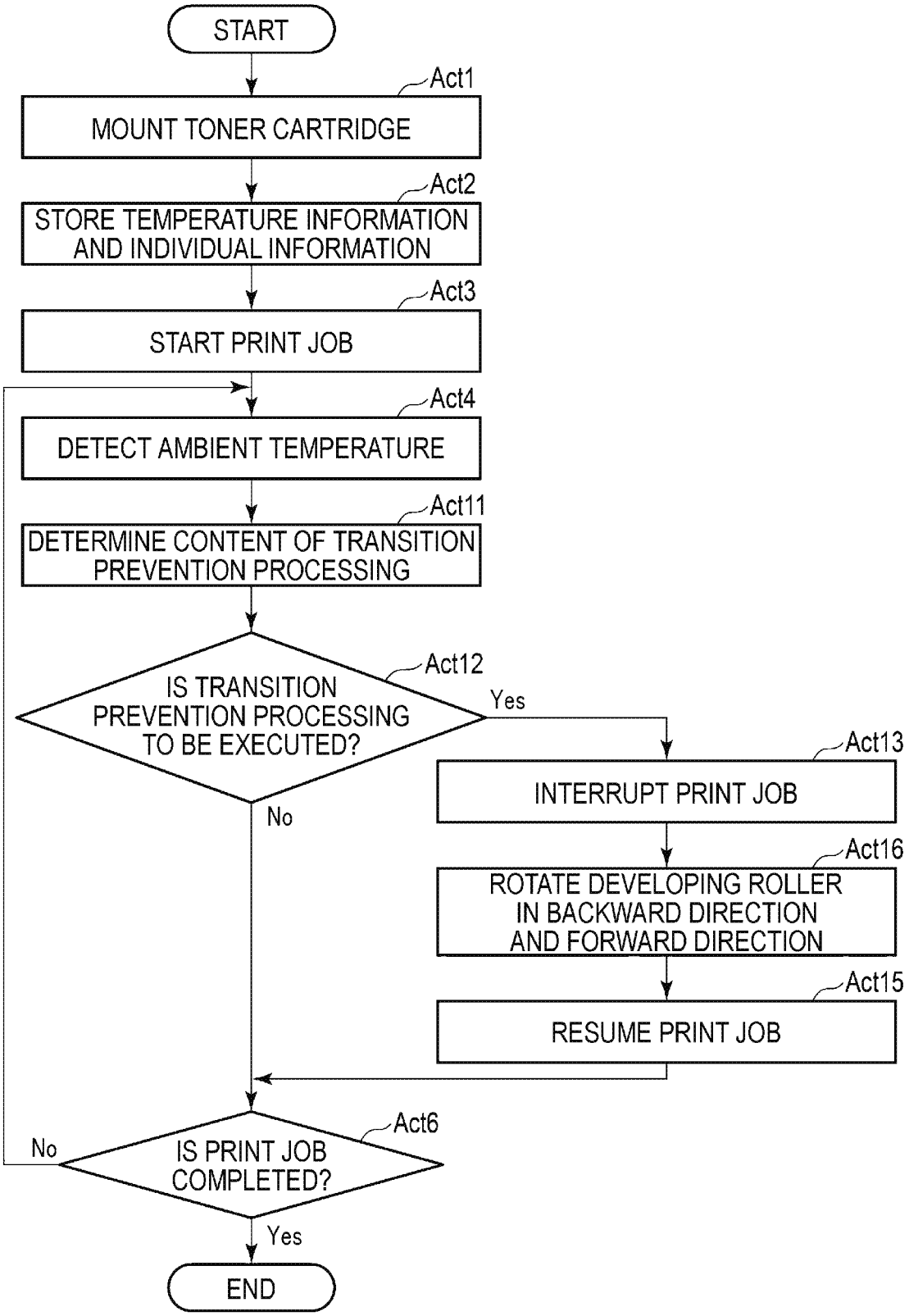
FIG. 6 is a flowchart showing a second example of toner transition prevention processing of the second embodiment.

Next, the toner transition prevention processing will be described with reference to the flowchart shown in FIG. 6. In the following description, the same operation as that of the first example described above is given the same reference symbol to simplify the description. The second example is different from the first example in the transition prevention processing.

Specifically, in the second example, the following processing of Act 16 is performed instead of the first processing of Act 14. That is, the processor 22 breaks and separates the toner 8 in contact with the developing roller 55 by instructing the printer control unit 15 to repeatedly rotate the developing roller 55 of the process unit 41 of the corresponding group in a backward direction less than one time, for example, about ¼ turn and in a forward direction of the same degree in a predetermined number of times.

As described above, the toner transition prevention processing of the second example has the same function and effect as the first example described above. Furthermore, since the backward rotation and the forward rotation of the developing roller 55 are repeatedly performed, the solidified toner 8 can be further broken and separated.

As a modification example of the second example, in the transition prevention processing, the backward rotation and the forward rotation of the small movement distance of the developing roller 55 may be repeatedly performed for an arbitrary time to vibrate the developing roller 55.

In addition, as a vibration source that applies vibration to the developing roller 55 and the layer restricting member 59, a vibrating member, for example, a piezoelectric body may be separately provided in the developer container 58 in the vicinity of the layer restricting member 59. When such a separate vibration member is provided, the transition prevention processing of the toner 8 can be performed while executing the print job at the timing when the developing roller 55 is not operating.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing device comprising a developing roller configured to develop an electrostatic latent image with a toner supplied from at least one toner cartridge having a storage medium configured to store temperature information regarding melting of a contained toner;

a temperature sensor that detects an ambient temperature of an atmosphere including the developing device; and a controller configured to drive the developing roller of the developing device based on the ambient temperature detected by the temperature sensor and the temperature information stored in the storage medium wherein the controller is further configured to determine whether the ambient temperature detected by the temperature sensor falls within any one of a plurality of temperature ranges in accordance with a difference from a reference temperature indicated by the temperature information stored in the storage medium, and drive the developing roller of the developing device according to the temperature range, and wherein the controller is configured to increase a frequency of driving the developing roller as the difference of the temperature range decreases.

2. The apparatus according to claim 1, wherein the temperature information comprises a temperature based on a glass transition temperature (Tg) of the toner.

3. The apparatus according to claim 1, wherein the developing device comprises a layer restricting member disposed close to the developing roller and configured to restrict a thickness of a developer layer including the toner adhering to the developing roller, and driving of the developing roller comprises either driving to rotate the developing roller in a backward direction or driving to repeat backward rotation and forward rotation of the developing roller.

4. The apparatus according to claim 3, wherein an amount of rotation of the developing roller in the driving the developing roller is less than one rotation.

5. The apparatus according to claim 1, wherein when the ambient temperature detected by the temperature sensor reaches or exceeds a reference temperature indicated by the temperature information stored in the storage medium, the controller is configured to drive the developing roller of the developing device.

6. An image forming apparatus, comprising:

a developing device comprising a developing roller configured to develop an electrostatic latent image with a toner supplied from at least one toner cartridge having a storage medium configured to store temperature information regarding melting of a contained toner;

a temperature sensor that detects an ambient temperature of an atmosphere including the developing device; and a controller configured to drive the developing roller of the developing device based on the ambient temperature detected by the temperature sensor and the temperature information stored in the storage medium, wherein the image forming apparatus comprises a plurality of toner cartridges, the toner includes a first group including a black toner, a second group including a plurality of chromatic toners excluding the black, and a third group including a decolorable toner, the image forming apparatus further comprises a plurality of the developing devices and a plurality of the temperature sensors corresponding to a plurality of the toner cartridges, and the controller is further configured to drive the developing roller corresponding to the toner cartridge containing the toner of the first group based on the temperature information stored in the storage medium of the toner cartridge containing the toner of the first group and the ambient temperature, drive all of the developing rollers corresponding to the plurality of the toner cartridges containing the toners of the second group based on each of the temperature information stored in the storage medium of the plurality of the toner cartridges containing the toners of the second group and the ambient temperature, and drive the developing roller corresponding to the toner cartridge containing the toner of the third group based on the temperature information stored in the storage medium of the toner cartridge containing the toner of the third group and the ambient temperature.

7. The apparatus according to claim 1, wherein the toner contained in the at least one toner cartridge includes a low-temperature fixing toner that begins to soften at 50° C. or less.

8. An image forming method in an image forming apparatus including a developing device configured to develop an electrostatic latent image with a toner supplied from at least one toner cartridge having a storage medium configured to store temperature information regarding melting of the contained toner, the method comprising:

detecting an ambient temperature of an atmosphere including the developing device by a temperature sensor;

reading the temperature information from the storage medium of the toner cartridge by a reader;

driving the developing device based on the detected ambient temperature and the read temperature information;

determining whether the ambient temperature falls within any one of a plurality of temperature ranges in accordance with a difference from a reference temperature indicated by the temperature information stored, driving the developing device according to the temperature range, and increasing a frequency of driving the developing device as the difference of the temperature range decreases.

9. The method according to claim 8, wherein the temperature information comprises a temperature based on a glass transition temperature (Tg) of the toner.

10. The method according to claim 8, further comprising:

restricting a thickness of a developer layer including the toner adhering to the developing roller using a layer restricting member, and driving of the developing device comprises either driving to rotate a developing roller in a backward direction or driving to repeat backward rotation and forward rotation of the developing roller.

11. The method according to claim 10, further comprising:

driving the developing roller less than one rotation.

12. The method according to claim 8, further comprising:

when the ambient temperature detected reaches or exceeds a reference temperature indicated by the temperature information stored, driving the developing device.

13. The method according to claim 8, wherein the image forming apparatus comprises a plurality of toner cartridges, the toner includes a first group including a black toner, a second group including a plurality of chromatic toners excluding the black, and a third group including a decolorable toner, and a plurality of the developing devices and a plurality of the temperature sensors corresponding to a plurality of the toner cartridges, the method further comprising:

driving a developing roller corresponding to the toner cartridge containing the toner of the first group based on the temperature information stored in the storage medium of the toner cartridge containing the toner of the first group and the ambient temperature, driving all developing rollers corresponding to the plurality of the toner cartridges containing the toners of the second group based on each of the temperature information stored in the storage medium of the plurality of the toner cartridges containing the toners of the second group and the ambient temperature, and driving the developing roller corresponding to the toner cartridge containing the toner of the third group based on the temperature information stored in the storage medium of the toner cartridge containing the toner of the third group and the ambient temperature.

14. A development control system, comprising:

a developing device configured to develop an electrostatic latent image with a toner supplied from at least one toner cartridge having a storage medium configured to store temperature information regarding melting of a contained toner;

a temperature sensor that detects an ambient temperature of an atmosphere including the developing device;

a controller configured to drive the developing device based on the ambient temperature detected by the temperature sensor and the temperature information stored in the storage medium; wherein the controller is further configured to determine whether the ambient temperature falls within any one of a plurality of temperature ranges in accordance with a difference from a reference temperature indicated by the temperature information, drive the developing device according to the temperature range, and increase a frequency of driving the developing device as the difference of the temperature range decreases.

15. The development control system according to claim 14, wherein the toner contained in the at least one toner cartridge includes a low-temperature fixing toner that begins to soften at 50° C. or less.

16. The development control system according to claim 14, wherein the temperature information comprises a temperature based on a glass transition temperature (Tg) of the toner.

* * * * *